United States Patent [19]

Smith et al.

[11] 4,434,017

[45] Feb. 28, 1984

[54] EXPLOSIVE COMPOSITION

[75] Inventors: Lindsay K. Smith, South Caulfield; Michael A. Yabsley, Cheltenham, both of Australia

[73] Assignee: ICI Australia Limited, Melbourne, Australia

[21] Appl. No.: 254,493

[22] Filed: Apr. 15, 1981

[30] Foreign Application Priority Data

Apr. 15, 1980 [AU] Australia ..... PE3147

[51] Int. Cl.[3] ..... C06B 45/00

[52] U.S. Cl. ..... 149/2; 149/21; 149/41; 149/42; 149/43; 149/44; 149/60; 149/61; 149/76; 149/83; 149/85

[58] Field of Search ..... 149/2, 21, 41, 42, 43, 149/44, 60, 61, 76, 83, 85

[56] References Cited

U.S. PATENT DOCUMENTS 3,926,696 12/1975 Klunsch et al. ..... 149/60

3,996,078 12/1976 Klunsch et al. ..... 149/60

*Primary Examiner*—Stephen J. Lechert, Jr.

*Attorney, Agent, or Firm*—Cushman, Darby & Cushman

[57] ABSTRACT

A gas-bubble-sensitized melt explosive composition, which is not deleteriously affected by pumping, containing certain surfactants which inhibit the disengagement of the sensitizing gas bubbles.

21 Claims, No Drawings

EXPLOSIVE COMPOSITION

This invention relates to explosive compositions and to their preparation; in particular, it relates to non-aqueous explosive compositions comprising an oxidiser salt, a fuel material miscible with the oxidiser salt in the liquid state and gaseous bubbles.

Such explosive compositions, which are alternatively termed melt explosive compositions, may be pumpable, pourable and flowable liquids or slurries, or may be solids. However, if they are solids it is implicit that they have been prepared in a liquid or slurry state and solidified by cooling.

By 'miscible' we mean that the oxidiser salt and fuel material when mixed together in certain proportions, depending on their nature, and, if necessary heated, form a mobile melt. It is the presence of this melt in non-aqueous explosive compositions which imparts the pumpable, pourable and flowable properties.

The oxidiser salt is not an explosive in its own right but it is explosive when mixed with the fuel.

Melt explosive compositions have been known for many years. Thus as early as 1934 in U.S. Pat. No. 2,063,572 there are descriptions of processes for making high density explosives by incorporating ammonium nitrate and a freezing point depressant to produce a composition which had a relatively broad melting point range and heating it to a temperature sufficient to liquify a portion only of the ammonium nitrate with the freezing point depressant. The material so produced was compacted by extruding whilst it was hot and then pressed or tamped into containers wherein it cooled to a solid, high density explosive. In this document it was taught that ammonium nitrate by itself was not sufficiently sensitive for use as an explosive and it was preferred that there be included in the composition up to 25% of a sensitizing agent such as trinitrotoluene or or pentaerythritol tetranitrate. In the U.S. Pat. No. 2,817,581 there is described a cast explosive composition comprising a solid mixture of 14 to 20 parts by weight of urea, 1 to 6 parts by weight of a high explosive sensitizing component such as cyclotrimethylene trinitramine and the remainder to 100 parts of ammonium nitrate. In U.S. Pat. No. 2,814,855 there is described another cast solid explosive composition comprising 16-21 parts by weight of urea crystals, 1-3 parts of an adsorbent such as kaolin in admixture with an amount of ammonium nitrate sufficient to give 100 parts of an explosive composition.

In U.S. Pat. No. 3,135,637 there is described a solid blasting explosive comprising a reaction mixture of ammonium nitrate and a urea-aliphatic hydrocarbon clathrate. Still further in U.S. Pat. No. 3,247,033 there is described solid explosive compositions comprising ammonium nitrate and primary fuel material optionally in combination with secondary fuel material and modifying material. It is taught therein that the components of such compositions should be heated to a temperature between 150° C. and 165° C. to form a molten mass which is then chilled rapidly to form a solid product which is subsequently flaked, granulated and densified and which is said to be advantageous in that it contains a desirable crystal form, is less prone to segregation and non-homogeneity of the components and leads to enhanced contact between the components of the composition.

The compositions referred to above are typical of known melt explosive compositions and they have a common attribute in that they are solid compositions and it is taught in the documents describing them that they should be used in the solid state. Thus they are designed to be used in a manner similar to that for the well known mixtures of ammonium nitrate and fuel oil (ANFO). Whilst such compositions are satisfactory in many respects as explosives, they have suffered from the disadvantage that it has often been found to be difficult in practice to load them into boreholes at commercially acceptable loading rates. Thus to achieve a desired packing density, and hence a desired available bulk energy, it is common to use vibrating or tamping means to locate dry explosive compositions in boreholes. Such means are sometimes not effective when granular prior art compositions are loaded at high rates into large diameter boreholes, leading to reduced and nonhomogeneous packing densities. So as to overcome these deficiencies of solid explosives it has been proposed to use water bearing explosive compositions which in general terms comprise a mixture of oxidizing salt material, fuel material and water in proportions such that the compositions are pourable or pumpable. These compositions, often referred to as slurry explosives, have been useful but they suffer from the disadvantage that the water component thereof acts as a diluent which contributes little to the energy which becomes available when the composition is detonated.

Water-bearing explosive compositions have a low energy to volume ratio and it is desirable, for some purposes, to provide a pumpable, pourable or flowable explosive compositions which is substantially water free. Hence it has been proposed that explosive compositions having low solidification points be made. Thus in U.S. Pat. No. 3,926,696 provision is made for explosive compositions having as essential components an oxygen supplying salt such as ammonium nitrate, a metallic fuel such as aluminium or magnesium, and an eutectic mixture comprising an oxygen supplying salt and a combustible compound which lowers the solidification point of the salt and wherein the compositions are characterized in that they have solidification points below +10° C. and preferably below −10° C. In U.S. Pat. No. 3,996,078 which was derived from U.S. Pat. No. 3,926,696 there is described an eutectic composition consisting essentially of an oxygen supplying salt, a combustible compound and at least 30% w/w of a nitrate or perchlorate of an alkanolamine, the composition having a solidification point below −10° C.

In the realm of explosives manufacture it is considered to be desirable to use process conditions or components of compositions which lead to a minimum of hazard. Thus it is desirable that temperatures used in the preparation of explosive compositions are kept relatively low so as to avoid undesired detonation or burning of the compositions, hence use has been made of low melting eutectics of the oxidiser salt and fuel material to provide the liquid phase in non-aqueous pumpable, pourable and flowable explosive compositions.

Frequently it is necessary to increase the sensitivity to detonation of melt explosive compositions. This can sometimes be achieved by the incorporation of high explosives such as trinitrotoluene, nitroglycerine, pentaerythritol tetranitrate, picric acid, nitro starch, cyclotrimethylenetrinitramine and the like. However, care has to be taken in using such high explosives, and where for a particular purpose their use is unavoidable, the proportion thereof should be as small as possible.

There are other means of enhancing the sensitivity of non-aqueous explosive compositions which include the incorporation of such substances as the alkanolamine nitrates, alkanolamine perchlorates or unstabilized alkylene glycol nitrates, or inorganic materials like finely divided aluminium, magnesium or ferrosilicon.

Another means of imparting sensitivity to melt explosive compositions is to incorporate a discontinuous gaseous phase therein. This may be achieved by the inclusion of hollow particles, sometimes described as microballoons, or porous particles. Alternatively the gaseous phase may take the form of gas bubbles homogeneously dispersed throughout the composition: the compositions of the present invention are of this last type, namely 'gas-bubble-sensitised' melt explosive compositions.

British Pat. No. 839,078 describes a gas-bubble-sensitised melt explosive composition in which the gas bubbles have been generated by chemical means. Alternatively the gas bubbles can be introduced by mechanical aeration.

Melt explosive compositions provide a suitable means to supply bulk explosives. They are pumped into the boreholes and depending on the residence time and ground temperature they may solidify and set. They may be initiated in the liquid or solid form. However gas-bubble-sensitised melt explosives are liable to desensitisation by pumping because of disengagement of the gas bubbles from the composition. Furthermore gas bubble disengagement can also take place if the compositions stand for any length of time in a fluid or molten state. This gas bubble disengagement manifests itself in an increase in the density of the composition. Usually it is necessary for a gas-bubble-sensitised explosive composition to have a density not greater than 1.40 g./c.c. If on pumping the density rises above this level, the composition is likely to be too insensitive to be a useful explosive. In addition to the loss of reduction in sensitivity associated with densification of the composition, there is a further undesirable aspect associated with the fact that explosive bulk energy is related to density. Frequently it is desirable to modify the bulk energy of the charge even within the same borehole to accommodate compression of the charge by water head or explosive head and/or variations in the rock to be blasted, hence any uncontrolled change in density which alters the bulk energy on the charge is undesirable.

We have now found that gas-bubble-sensitised melt explosive compositions are stabilised against gas bubble disengagement by the inclusion of certain cationic and non-ionic surfactants.

Accordingly the present invention provides a density-stabilised gas-bubble-sensitised melt explosive composition having a density not greater than 1.4 g./c.c. characterised in that the said composition contains a foam-stabilising surfactant, as hereinafter defined, in an amount in the range of 0.05 to 2.00 percent on a w/w basis.

The foam stabilising surfactant may consist of one or more surfactant species.

By 'density-stabilised' we mean that the said composition in its liquid or slurry state does not become substantially more dense on pumping or standing; nor do the gas bubbles grow or coalesce so that their sensitising effect is lost. Desirably, any density increase is less than 10% of the 'as-prepared' density.

The said gas-bubble-sensitised melt explosive compositions comprise essentially an oxygen releasing salt, a melt soluble fuel material, a thickening agent, gas bubbles and the characterising foam stabilising surfactant. In addition, the said composition optionally comprise a cross-linking agent, water up to 3 percent w/w, and secondary fuels, either in a liquid or solid form.

Suitable oxygen releasing salts for use in the compositions of this invention are alkali metal nitrates, alkaline earth metal nitrates, ammonium nitrate or their chlorate and perchlorate equivalents. Preferably the oxygen releasing salt component constitutes between 60 and 80 percent w/w of the composition and is ammonium nitrate or a blend of ammonium nitrate and sodium nitrate. The preferred composition range for such a blend is between 5 and 20 parts by weight of sodium nitrate with 100 parts ammonium nitrate.

By melt soluble fuel material is meant a fuel material which is capable of forming a eutectic mixture with the oxygen releasing salt; the melting point of the eutectic mixture being less than the melting point of either the fuel material or the oxygen releasing salt. It is desirable that the melt soluble fuel material be capable of forming a miscible melt with ammonium nitrate, the preferred oxygen releasing salt. Thus in the preferred compositions containing ammonium nitrate the melt soluble fuel materials, hereinafter referred to as the primary fuel, may be defined as an organic compound which is capable of forming a homogeneous eutectic melt with ammonium nitrate and of being oxidized by ammonium nitrate to form substantially all gaseous products. The primary fuel may be a single compound or a mixture of two or more compounds. Suitable primary fuels include carboxylates, thiocyanates, short chain amines, imides or amides. Typical useful primary fuels include ammonium acetate, ammonium formate, ammonium thiocyanage, hexamethylene tetramine, dicyanodiamide, thiourea, acetamide, urea and mixtures thereof. The preferred primary fuel is provided by between 15 and 30 percent w/w of urea.

The thickening agents are used in the compositions of the invention in amounts between 0.05 and 2 percent w/w. They are suitably polymeric materials, especially gum materials typified by the galactomannan gums such as locust bean gum or guar gum or derivatives thereof such as hydroxypropyl guar gum. Other useful, but less preferred, gums are the so called biopolymeric gums such as the heteropolysaccharides prepared by the microbial transformation of carbohydrate material, for example the treatment of glucose with a plant pathogen of the genus Xanthomonas typified by *Xanthomonas campestris*. Polymeric materials derived from acrylamide are also useful thickeners.

In order that the compositions of the present invention will have the desired consistency, it is preferable for the thickening agent to be crosslinked. It is convenient for this purpose to use conventional crosslinking agents such as zinc chromate or a dichromate either as a separate entity or as a component of a conventional redox system for example a moisture of potassium dichromate and potassium antimony tartrate. Surprisingly it has been found in many instances that the thickening agents do not require the presence of water in the compositions to be efficacious. However should it be considered desirable that the solvation of gummy thickening agents or their crosslinking would be enhanced by the presence of small amounts of water or a water-bearing medium, it lies within the scope of the invention that there be present in the composition a sufficiency of water to enable such solvation or crosslinking to be effected, provided that the total water content of the composition does not exceed 3 percent on a w/w basis.

The gaseous bubbles may be introduced into the composition by mechanically aerating the composition as it is being prepared or by adding a chemical, gassing agent such as a mixture of sodium nitrate and thiourea. The amount of gaseous bubbles incorporated is such as to produce compositions of density less than 1.40 g/c.c. Preferably it is such that the density is less than 1.35 g./c.c.

Although the stabilisation of foams in aqueous systems by surfactants is well known and the type of suitable surfactant is predictable, the use of surfactants for foam stabilisation in non-aqueous systems, such as are the compositions of this invention, is not well-known and suitable surfactants cannot be predicted. However we have found that there is a correlation between the results obtained from a foam stabilisation test, described hereinafter and the density stabilising effect of various surfactants on melt compositions containing air bubbles.

In the said foam stabilisation test 10 g of a eutectic composition consisting of 46.7% ammonium nitrate, 43.6% urea and 9.7% sodium nitrate, all on a w/w basis, is heated to 70° C. to form a melt in a graduated cylindrical vessel of 10 m.m. internal diameter. 0.5% of the candidate surfactant or mixture of surfactants to be tested is added to the melt and the vessel is shaken for one minute. A foam forms on the surface of the melt. The height ($f_5$) of this foam is measured after 5 minutes using the graduations on the vessel. The foam height ($f_{60}$) is measured again after 60 minutes, the vessel and melt being kept at 70° C. all the time. A foam stability parameter is calculated from the foam heights according to the following formula:

$$\phi_5^{60} = \frac{\text{foam height after sixty minutes, } f_{60}}{\text{foam height after five minutes, } f_5}$$

By way of illustration of the application of the foam stabilisation test, Table 1 records the results for a number of surfactants and surfactant mixtures.

TABLE 1

| Foam Stabilisation Tests | | | |
|---|---|---|---|
| Surfactant A | Co-surfactant B (if B present ratio w/w of A: B = 5:1) | Foam Properties $f_H^5$mm | $\phi_5^{60}$ |
| 'Farmin' C ($C_{12}$ amine) | | 11 | 0.73 |
| 'Farmin' O (oleylamine) | | 4 | 0.5 |
| 'Duomeen T (Tallow propylene diamine) | | 8 | 0.63 |
| 'Armeen' HT ($C_{18}$ amine) | | 7.5 | 0.8 |
| 'Armeen' 16D (hexadecylamine) | | 4.5 | 0.78 |
| 'Armeen' 18D (octadecylamine) | | 10 | 0.7 |
| 'Armac' 12D ($C_{12}$ amine acetate) | | 19.5 | 0.56 |
| 'Oxamin' LO ($C_{12-14}$ amine oxide) | | 3.5 | 0.57 |
| 'Emigen' AB (N—N—dimethyl laurylamine) | | 12.5 | 0.44 |
| 'Farmin' DM40 (dimethyl myristyl amine) | | 2 | 0.5 |
| 'Farmin' DMC (dimethyl cocoamine) | | 7 | 0.43 |
| 'Farmin' DM86 (dimethyl stearyl amine) | | 2.5 | 0.40 |
| 'Farmin' DM20 (N—N dimethyl lauryl amine) | | 10.5 | 0.52 |
| 'Alkadet' 15 ($C_{9-11}$ glucoside) | | 6 | 0.8 |
| 'Dobanol' 91 ($C_{9-11}$glucose acetal) | | 6 | 0.8 |
| 'Teric' 307 ($C_{12-14}$ethoxylated phosphate) | | 2 | 0.75 |
| 'Teric' CME3 (ethoxylated cocomonoethanolamide)* | | 1.5 | 0 |
| 'Teric' CME7(ethoxylated cocomonoethanolamine)* | | 2 | 0 |
| 'Teric' 18M2 (ethoxylated $C_{18}$ amine) | | 4 | 2.3+ |
| 'Teric' 12M2 (ethoxylated $C_{12}$ amine) | | 3 | 0.67 |
| 'Teric' 17A8 (ethoxylated $C_{16-18}$ alcohol) | | 3 | 0.8 |
| 'Teric' ALE25 (ethoxylated lauryl ether sulphate | | 2 | 0.5 |
| 'Emigen' BB ($C_{12-14}$ betaine)* | | 9.5 | 0.10 |
| Lauric Acid* | | | |
| Sodium Stearate* | | | |
| Calcium Stearate* | | | |
| Sodium lauryl sulphate* | | | |
| 'Armeen' 2HT (secondary | | | |

TABLE 1-continued

| Foam Stabilisation Tests | | | |
|---|---|---|---|
| Surfactant A | Co-surfactant B (if B present ratio w/w of A: B = 5:1) | Foam Properties $f_H^5$mm | $\phi_5^{60}$ |
| amine)* | | | |
| 'Armeen' T08 (tertiary amine* | No foam formed | | |
| 'Armid' HT ($C_{18}$ amide)* | | | |
| 'Synprol' ($C_{13-15}$ alcohol)* | | | |
| Octadecanol* | | | |
| 'Matexil' (sodium diisocctyl sulpho-succinate)* | | | |
| 'Armeen' HT | Octadecanol | 13.5 | 0.55 |
| 'Armeen' HT | 'Teric' 307 | 21 | 0.62 |
| 'Armeen' HT | 'Teric' CME7 | 15.5 | 0.57 |
| 'Armeen' HT | 'Teric' ALE25 | 16 | 0.66 |
| 'Armeen' HT | 'Teric' 12A3 | 25 | 0.44 |
| 'Armeen' HT | 'Teric' CME3 | 24 | 0.48 |
| 'Teric' 18M2 | 'Teric' 307 | 7 | 2.4+ |
| 'Teric' 18M2 | 'Teric' 12A3 | 3 | 2.7+ |

('Farmin', 'Duomeen', 'Armeen', 'Armac', 'Oxamin', 'Emigen', 'Alkadet', 'Dobanol', 'Teric', 'Synprol', 'Armid', and 'Matexil' are trade names).
+ In some instances the foam bubbles continue to rise to the surface of the test liquor after the five minute reading. This can cause the value of $\phi_5^{60}$ to be greater than unity).

The asterisks in Table 1 indicate those surfactants unsuitable as density stabilisers. It has been found that only those surfactants or mixtures of surfactant species which gave an initial foam height, $f_5$, result equal to or greater than 2 mm and had a stability parameter greater than 0.30 imparted the desired density stabilisation effect which characterises the compositions of this invention, when included in gas-bubble-sensitised melt explosive compositions. Hence the foam-stabilising surfactants of the invention are defined as those having an $f_5$ value equal to or greater than 2 mm and $\phi_5^{60}$ greater than 0.3 by the foam stabilisation test hereinbefore defined.

The preferred type of surfactant is a long, straight chain, organic primary amine containing at least 6 carbon atoms in the molecular structure. More to be preferred are long, straight chain, organic primary amines containing between 12 and 22 inclusive carbon atoms in their molecular structure. Another preferred type of surfactant is an ethoxylated, straight chain organic amine containing at least 8 carbon atoms in the molecular structure.

It is not necessary to add more than 2.00% w/w of foam-stabilising surfactant to the melt explosive compositions of this invention for it to have the desired effect but, of course, higher proportions will stabilise the foam. Economically, being a high-cost ingredient, it is desirable to keep the level of addition of foam stabilising surfactant to the minimum having the desired effect. The preferred level of addition is an amount in the range of 0.3 percent to 1.5 percent w/w on the basis of the whole composition.

In practice, the components used to make the explosive compositions of the invention may contain water of crystallisation and/or free moisture, hence it is anticipated that there may be up to 3 percent w/w water in the said compositions. Some water may also be introduced in order to solvate the thickening system used as has been hereinbefore referred to. However the presence of water in the composition is undesirable because it detracts from the explosive properties of the composition and it is therefore kept to a practicable minimum.

Secondary fuel materials which are not melt soluble may be chosen from a range of materials and include for instance sulphur aluminium, silicon, carbon and liquid or solid carbonaceous materials. Some liquid carbonaceous materials are unsuitable because they interfere with the density stabilising property of the surfactant. For this reason solid carbonaceous materials are used as secondary fuels, for example comminuted coke or charcoal, carbon black; resin acids such as abietic acid or derivatives thereof; sugars such as sucrose or dextrose' or other vegetable products such as starch, nut meal or wood pulp. Particulate aluminium is the preferred secondary fuel.

The process of making the gas-bubble-sensitised melt explosive compositions is essentially a mixing process and the sequence of addition of the components to the mix is not critical. It is preferred, however, to incorporate the gas bubbles as late as possible in the manufacture of the compositions because thereby the likelihood of disengagement of the gas bubbles is minimised and the mix is insensitive for a maximum time during the manufacture process; the gas bubbles being the sensitising agent.

A preferred method of preparation of the melt explosive compositions is to first prepare a prethickened melt comprising a portion of the oxygen releasing salt component, the melt soluble fuel material, the thickening agent and the foam stabilising surfactant. To this melt there is added a mixture comprising the remainder of the oxygen releasing salt component and optionally a crosslinking agent and/or secondary fuel. If the gas bubbles are to be formed by chemical means, the chemical gassing agent is added to the mixture. If mechanical means are used to introduce the gas bubbles, a blend of the melt and the mixture is subjected to a mechanical aeration process, such as beating or vigorously stirring.

The compositions of the invention are useful as fillings in explosive cartridges and they are also eminently suitable for use in conjunction with conventional pumping or mixing trucks designed for use with known water based explosives of the so-called slurry type. Thus for example a thickened melt component of the compositions of the invention may be placed in the solution tank of such a conventional mixing truck and the residual components of the compositions may be added to and mixed with the melt in a conventional manner and thereafter the composition of the invention so prepared may be transferred to a borehole wherein it may be detonated.

The compositions of the invention have similar explosive bulk energy to other known non-aqueous compositions which are pumpable, pourable or flowable with the advantage that they have stable densities. Moreover these new compositions are devoid, in terms of essential components, of high explosive materials, per se.

The new compositions of the invention may be made having as wide a range of densities as 0.30 g./c.c. to 1.40 g./c.c. The very low density (0.70 g./c.c.) compositions are of particular utility when a low explosive energy/-volume explosive is desired, for instance when minimal backbreak is required during open pit blasting.

One way of making such low density compositions is to mechanically aerate vigorously a suitable melt composition until the desired density is achieved and then to add crosslinking agent to crosslink the thickening agent in the melt. Without the addition of the characterising surfactant such compositions cannot be pumped or stored without considerable increase in density.

This invention is now illustrated by, but is not limited to, the following examples, except examples 3, 4, 5 and 8. All parts and percentages are expressed on a weight basis unless otherwise specified.

EXAMPLE 1

A preferred composition was prepared as follows.

Ammonium nitrate, sodium nitrate and urea were mixed according to proportions given below for Mixture A.

| Mixture A | Parts |
|---|---|
| ammonium nitrate | 57.9 |
| sodium nitrate | 10.6 |
| urea | 31.5 |
| sodium acetate | 0.5 |
| acetic acid (glacial) | 0.5 |
| surfactant 'Farmin C' | 0.5 |

This mixture A was melted by heating and thickened by mixing in 0.1 parts by guar gum at 65° C. and standing overnight.

To 61 parts of this mixture A 39 parts of Mixture B ingredients were added in a planetary mixer.

| Mixture B Ingredients | Parts |
|---|---|
| ammonium nitrate prills | 38.9 |
| sodium nitrite as 33.33% aqueous solution | 0.1 |

A sample of the resulting composition was recirculated through a pneumatically operated piston pump five successive times. The density of the sample prior to pumping was 1.10 g/cc whilst after pumping the density was 1.05 g/cc.

This sample was then cooled to 20° C. and stored for a period of one week.

The sample was then detonated in a 79 mm steel pipe using a 100 g pentolite booster. The VOD was measured to be 4.5 km/sec.

EXAMPLE 2

A composition was prepared according to the procedure already described for example 1. In this example the Mixture A contained 0.5 parts of the surfactant 'Alkadet' 15,in place of 'Farmin C'. It was thickened by addition of 0.1 parts guar gum and 0.2 parts starch.

Thirty nine parts of ammonium nitrate prills were added to sixty one parts of the thickened mixture A and the composition loaded into 79 mm diameter steel tubes.

The composition density was 1.31 g/cc. The sample was stored for 1 week and then detonated with a 140 g pentolite booster at a VOD at 3.1 km/sec.

EXAMPLES 3–10

The compositions of these examples were identical in composition and preparation to that of Example 1 except for the variations listed in Table 2.

The densities of the compositions listed in Table 2 are those before storage. Experience has shown that such compositions are likely to increase in density on storage. However the failure of the compositions of Examples 5 and 8 to initiate may also be due to gas bubble coalescence.

TABLE 2

| | Surfactant | Parts Surfactant in Mixture A | Parts Guar Gum in Mixture A | Mix Density g/cc | Density after Cycling through pump five times | Storage Time | Primer wt of Pentolite | VOD km/sec |
|---|---|---|---|---|---|---|---|---|
| 3 | Nil | 0.0 | 0.1 | 1.14 | 1.29 | nt | nt | nt |
| 4** | Nil | 0.0 | 0.1 | 1.20 | 1.31 | nt | nt | nt |
| 5 | Nil | 0.0 | 0.2 | 1.06 | 1.14 | 1 week | 250 g | fail |
| 6 | Nonionic 'Teric 18M'*(Ethoxylated $C_{18}$ amine) | 0.6 | 0.1 | 1.11 | 1.04 | 1 week | 250 g | 3.6 |
| 7 | Cationic 'Farmic C' ($C_{12}$ amine) | 0.2 | 0.1 | 1.10 | 1.14 | 1 week | 250 g | 3.3 |
| 8 | Nonionic 'CEM 7' (ethoxylated coco-monoethanolamide) | 0.6 | 0.1 | 1.08 | 1.16 | 1 week | 250 g | fail |
| 9** | Nonionic Alkdet 15 ($C_9$ alkyl glucoside) | 0.5 | 0.1 | 1.22 | 1.16 | nt | nt | nt |
| 10 | Mixed 'Farmin C'/ 'Teric' 307 ($C_{12-14}$ | 0.6/0.3 | 0.1 | 1.11 | 1.06 | 1 week | 100 g | 4.6 |

TABLE 2-continued

| Surfactant | Parts Surfactant in Mixture A | Parts Guar Gum in Mixture A | Mix Density g/cc | Density after Cycling through pump five times | Storage Time | Primer wt of Pentolite | VOD km/sec |
|---|---|---|---|---|---|---|---|
| ethoxylated phosphate) | | | | | | | |

*No gassing solution - aerated by 'whipping'
**Contains 0.2 parts Hallmark 200 starch in Mixture a

EXAMPLE 11

A thickened melt solution containing the ingredients shown below as Mixture C was prepared by the procedure described for the thickened Mixture A in Example 1.

| Mixture C | Parts |
|---|---|
| ammonium nitrate | 58.2 |
| sodium nitrate | 11.1 |
| urea | 26.0 |
| water | 3.0 |
| guar gum | 0.35 |
| 'Farmin C' | 0.4 |
| sodium acetate | 0.4 |
| acetic acid | 0.4 |
| thiourea | 0.005 |

To 76 parts of Mixture C were mixed 24 parts of the ingredients listed as Mixture D using a mixer of the type commonly employed on watergel explosive mix trucks.

| Mixture D | Parts |
|---|---|
| ammonium nitrate prills | 24.0 |
| sodium nitrite as 33.33% aqueous solution | 0.15 |
| sodium dichromate as 50% aqueous solution | 0.10 |

The density of the resulting mixture (C and D) was 1.00 g/cc. This mixture was pumped at 40 kg/min through a lobed gear pump after which the density was 0.96 g/cc. The stored mixture (density 1.02 g/cc) was then loaded into 140 mm cylindrical containers and stored for 30 days. The mixture then detonated satisfactorily with a 30 g pentolite booster.

EXAMPLE 12

To 70 parts of mixture C were added 30 parts of mixture E and the composition processed and stored as described for Example 11.

| Mixture E | Parts |
|---|---|
| ammonium nitrate prills | 27.0 |
| fuel grade, aluminium | 3.0 |
| sodium nitrite as 33.33% aqueous solution | 0.15 |
| sodium dichromate as 50% aqueous solution | 0.10 |

This mixture detonated satisfactorily after 30 days storage with a 20 g Pentolite booster.

EXAMPLES 13 AND 14

Examples 11 and 12 were repeated in examples 13 and 14 respectively except that the 'Farmin C' surfactant in mixture C was replaced by 'Armeen' HT surfactant.

The products of these examples were processed and stored as described in Example 11. Subsequently they were satisfactorily detonated with a 20 g pentolite booster.

EXAMPLE 15

An explosive composition similar to that of Example 14 but with 63 parts of mixture C, 30 parts of mixture E and 7 parts of fuel grade aluminium was made and satisfactorily detonated.

EXAMPLE 16

A thickened melt solution containing the ingredients as Mixture C of example 11 was prepared except that 'Farmin C' in the mixture was replaced by 'Armeen' HT and thiourea was present in 0.02 parts.

To 70 parts of this mixture were mixed 30 parts of Mixture D using a commercial explosive mix truck of the type generally used for water gel explosives.

| Mixture D | Parts |
|---|---|
| ammonium nitrate prills | 26.9 |
| fuel grade aluminium | 3.0 |
| sodium nitrite as 33.33% aqueous solution | 0.20 |
| sodium dichromate as 33.33% aqueous solution | 0.09 |

The density of the resulting mixture was 1.05 g/cc. 5 tonnes of this mixture was pumped into 15 blast holes (265 mm diameter by 14 meters deep) and successfully detonated with 415 gm pentolite boosters.

Rock breakage and heave were observed to be excellent.

EXAMPLE 17

A thickened melt of composition F was prepared according to the procedure described in Example 1 for thickened Mixture A.

| Mixture F | Parts | |
|---|---|---|
| ammonium nitrate | 61.5 | |
| sodium nitrate | 11.0 | |
| urea | 24.5 | |
| water | 3.0 | |
| sodium methyl naphthalene sulphonate | 0.5 | (as a crystal habit modifier) |
| surfactant 'Farmin DMC' | 1.0 | |
| guar gum | 0.4 | |

After thickening this mixture was aerated by vigorous mixing to a density of 0.32 g/cc. To 100 parts of this composition was added 0.1 part of sodium dichromate crosslinking solution.

The material was mixed and stored for three days prior to testing. The sample was detonated in a 170 mm cylindrical container underwater using a 140 g pentolite booster. A bubble energy yield of 1.7 MJoule/kg was measured.

We claim:

1. A density-stabilized gas-bubble-sensitized melt explosive composition of density not greater than 1.4 g/cc comprising an oxygen releasing salt, a primary fuel material capable of forming an eutectic mixture with the said oxygen releasing salt, a thickening agent, gas bubbles, 0.0 to 3.0 percent by weight of water and 0.05 to 2.0 percent by weight of a surfactant selected from those surfactants which when subjected to a foam stabilization test wherein (i) 0.5 percent by weight of said surfactant is added to 10 g of a eutectic composition, consisting of 46.7 percent by weight of ammonium nitrate, 43.6 percent by weight of urea and 9.7 percent by weight of sodium nitrate, in a 10 mm diameter tube;

(ii) the mixture is heated to 70° C.; and (iii) the mixture is shaken for one minute; produces a foam which: after standing for a period of 5 minutes, has a height ($f_5$) greater than 2 mm; and after standing for a period of 60 minutes, has a ratio ($\phi_5^{60}$), of foam height after 60 minutes ($f_{60}$) to foam height after 5 minutes ($f_5$), of greater than 0.3.

2. An explosive composition according to claim 1 wherein the said surfactant is a mixture of at least two surfactant species and wherein said mixture has a $f_5$ value greater than 2 mm and $\phi_5^{60}$ value of greater than 0.3 according to said foam stabilisation test.

3. An explosive composition according to either one of claims 1 and 2 wherein the said surfactant constitutes between 0.3 and 1.5 percent w/w inclusive of the composition.

4. An explosive composition according to claim 1 wherein the said surfactant comprises a long straight chain primary amine containing at least six carbon atoms in its molecular structure.

5. An explosive composition according to claim 4 wherein the said long straight chain primary amine contains between 12 and 22 inclusive carbon atoms in its molecular structure.

6. An explosive composition according to claim 1 wherein the said surfactant comprises an ethoxylated straight chain organic amine containing at least eight carbon atoms in its molecular structure.

7. An explosive composition according to claim 1 wherein said primary fuel comprises a fuel selected from the group of compounds consisting of ammonium acetate, ammonium formate, ammonium thiocyanate, hexamethylene tetramine, dicyanodiamine, thiourea, acetamide, urea and mixtures thereof.

8. An explosive composition according to claim 1 which comprises as a primary fuel between 15 and 30 percent w/w of urea.

9. An explosive composition according to claim 1 which comprises a secondary fuel material selected from the group of fuels consisting of silicon, aluminium, sulphur, carbon, carbonaceous compounds and mixtures thereof.

10. An explosive composition according to claim 9 which comprises as a secondary fuel between 0.5 and 10 percent w/w of aluminium.

11. An explosive composition according to claim 1 which additionally comprises a crosslinking agent capable of crosslinking the said thickener.

12. An explosive composition according to claim 1 wherein the said oxygen releasing salt is selected from the group of salts consisting of alkali metal nitrates, alkaline earth nitrates, ammonium nitrate, alkali metal perchlorates, alkaline earth perchlorates, ammonium perchlorate, alkali metal chlorates, ammonium chlorates and mixtures thereof.

13. An explosive composition according to claim 12 which comprises as an oxygen releasing salt between 60 and 80 percent w/w of ammonium nitrate.

14. An explosive composition according to claim 11 which comprises as an oxygen releasing salt between 60 and 80 percent w/w of a mixture consisting of 100 parts by weight of ammonium nitrate and between 5 and 20 parts by weight of sodium nitrate.

15. An explosive composition according to claim 1 wherein the said thickening agent is selected from the group consisting of galactomannan gums, hydroxypropyl guar gum, polymeric materials derived from acrylamide and biopolymeric gums and constitutes between 0.05 and 2.0 percent w/w of said composition.

16. A process for the manufacture of a gas bubble sensitised melt explosive composition according to claim 1 wherein a melt comprising, as components, an oxygen releasing salt, a melt soluble fuel material, a thickening agent and a foam stabilising surfactant, as hereinbefore defined, is prepared by heating the said components together, the said melt is added to material comprising an oxygen releasing salt to form a slurry and the thus formed slurry is subjected to an aeration process to form the said explosive composition of the desired density.

17. A process according to claim 16 wherein the said aeration process comprises mechanical aeration process.

18. A process according to claim 16 wherein the said aeration process comprises a chemical aeration process in which gas generating agents are added to the said material to which the melt is added.

19. A process according to claim 16 wherein said material to which said melt is added additionally comprises a crosslinking agent capable of crosslinking the said thickening agent in the melt.

20. A process according to claim 16 wherein said material to which said melt is added additionally comprises a secondary fuel.

21. A process for the manufacture of an explosive composition according to claim 1 having a density less than 0.7 g/cc wherein a melt comprising an oxygen releasing salt, a melt soluble fuel material, a thickening agent and a foam stabilising surfactant is aerated mechanically until an aerated melt of the desired density is obtained and then a crosslinking agent is added to the aerated melt to crosslink the said thickening agent.

* * * * *